United States Patent [19]

Fairchild et al.

[11] 4,089,616

[45] May 16, 1978

[54] VIBRATORY SPLIT ROLL

[75] Inventors: Louis F. Fairchild, Cedar Rapids; Harlan M. Jones, Mechanicsville; Vernon L. Schrimper, Cedar Rapids, all of Iowa

[73] Assignee: Iowa Manufacturing Company, Cedar Rapids, Iowa

[21] Appl. No.: 794,606

[22] Filed: May 6, 1977

[51] Int. Cl.[2] ..... E01C 19/38

[52] U.S. Cl. ..... 404/117; 404/132

[58] Field of Search ..... 404/132, 117, 122; 172/518

[56] References Cited

U.S. PATENT DOCUMENTS

| | | | |
|---|---|---|---|
| 154,624 | 9/1874 | Wiard | 404/122 |
| 505,800 | 9/1893 | Pickles | 404/132 |
| 2,096,911 | 10/1937 | Moore | 404/122 X |
| 3,318,210 | 5/1967 | Schwamborn | 404/132 |
| 3,605,582 | 9/1971 | Kaltenegger | 404/117 |
| 3,670,631 | 6/1972 | Gaylord | 404/117 |

*Primary Examiner*—Nile C. Byers

*Attorney, Agent, or Firm*—Haven E. Simmons; James C. Nemmers

[57] ABSTRACT

A steerable split roll for a road roller includes a pair of roll shells containing means by which vibratory force is applied to each. Between adjacent ends of the roll shells a "turntable" type of bearing both connects the roll shells together for rotation relative to each other and maintains them in axial alignment.

20 Claims, 1 Drawing Figure

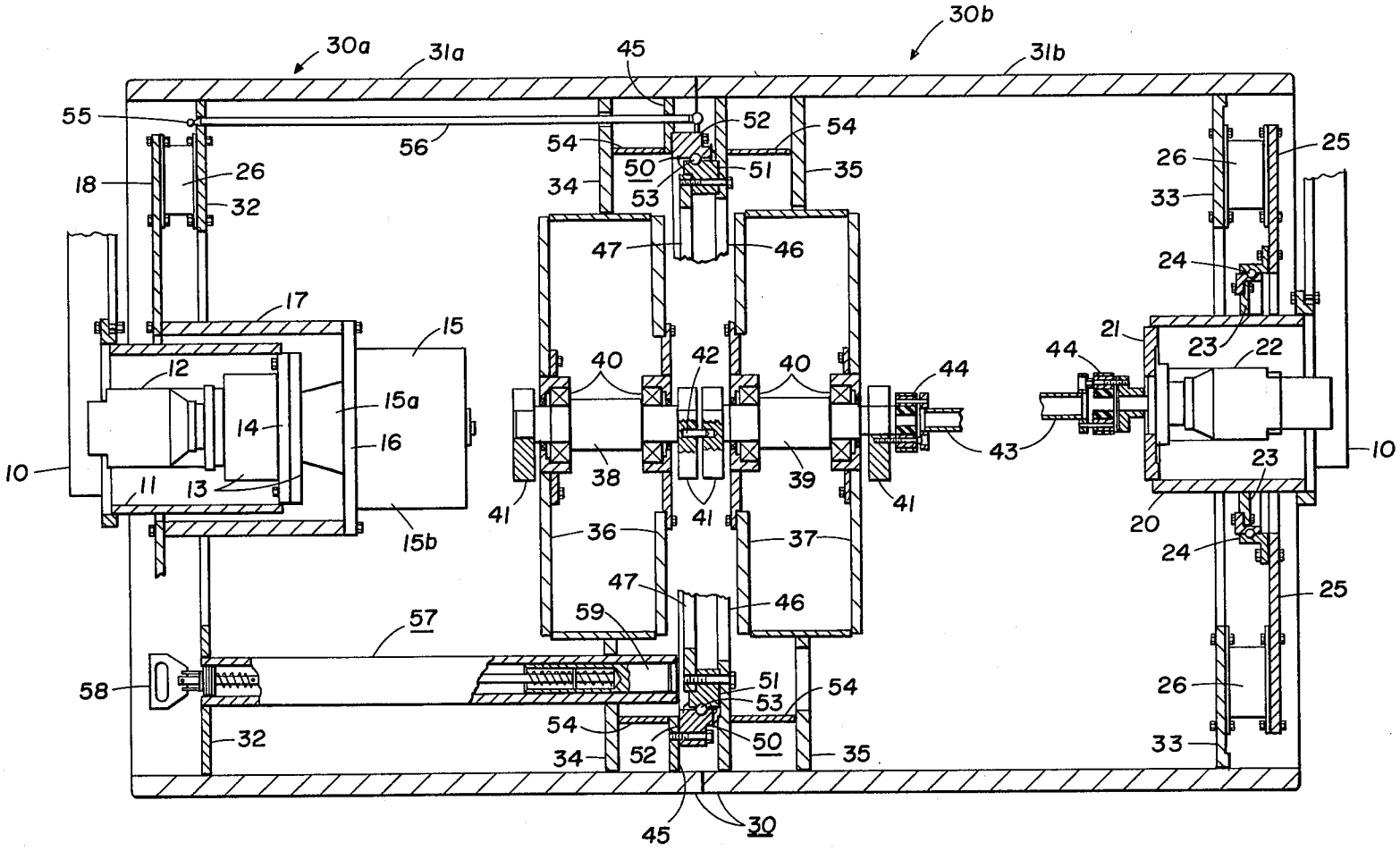
10
25
25
22
23
23
26
33
24
24
26
33
20
21
44
43
31b
30b
44
41
54
35
54
35
46
40
39
37
46
52
51
51
53
50
30
42
41
45
50
53
45
47
40
38
36
47
59
52
54
34
54
34
41
31a
56
15
15a
16
15b
57
30a
17
14
26
32
13
32
12
11
55
18
58
10

VIBRATORY SPLIT ROLL

BACKGROUND OF THE INVENTION

When one or more rolls of a road roller, especially one for compacting asphaltic road material, is or are also steerable, it is desirable that each roll be split into two or more roll shells which are rotable relative to each other. This is because otherwise scuffing of a newly laid asphalt mat will likely occur, the tighter the turn the greater the likelihood of scuffing. At the same time, modern asphalt paving practice has turned more and more toward the use of vibratory rolls in order to increase the density and uniformity of the mat and yet reduce the weight of the roller and the time required to do so.

But split rolls which can also be vibrated are not found in the prior art without many complications and deficiencies. The root of these lies in the substantial extra weight inherent in known vibratory split roll designs compared with non-vibratory split rolls. This is true not only when the vibratory mechanism is located outside the roll itself, and acts upon the overall roll assembly, as in U.S. Pat. No. 3,595,145, for instance, but especially when the vibratory mechanism is disposed within and largely carried by the roll itself, acting just upon the outer roll shell, as in U.S. Pat. No. 3,605,582, for instance. Apart from whether the vibratory mechanism is within or without the roll, some additional means in the case of split rolls must be employed which not only allows the rolls to vibrate together as a unit relative to the remainder of the roller, but which also allows them to rotate relative to each other and yet maintains them together in rigid axial alignment. One approach in the prior art has been to use an additional center frame member carrying the adjacent ends of a pair of heavy shafts upon which roll shells are journaled, thus also leaving a gap between the shells, as in U.S. Pat. No. 3,605,582 referred to. Another approach which has been considered is to use a single, large rigid shaft upon which both roll shells are journaled and associated with which is a vibratory mechanism of the eccentric type.

The trouble with all these approaches, however, is that they very materially increase the weight or mass of the roll. The greater the mass to be vibrated the less the amplitude of the roll for a given applied force at a given frequency. To increase the amplitude a greater applied force is required which in turn means greater eccentricity or heavier eccentric weights unless frequency is sacrificed. Reducing frequency, however, reduces efficiency of the roller because it decreases the speed at which the roller can travel along the new mat. Higher frequencies are desirable because they both increase the vibratory force and permit greater road speeds without impermissible skipping or gaps between the compactive thrusts upon the mat. But increasing the effective eccentric mass or the frequency, that is to say, the applied force, in order to compensate for increased weight of the roll demands larger bearings and more drive power with consequent greater frictional losses and problems of dissipating heat transmitted to the bearing lubricant. Indeed, it is these difficulties, perhaps, which account for the scarce use of vibratory split rolls for steering a roller, despite their desirability. Rather, the much more common practice is to use a relatively small, non-vibrating split roll or "tiller roll" for steering purposes while incorporating the vibratory mechanism in a single large roll which is non-steerable. However, when both rolls must necessarily be steered, as for instance in a tandem double articulated roller of the type shown in U.S. Pat. No. 3,868,194, the problems of also incorporating vibratory mechanism within them become more acute. The present invention arose in that context and while it is particularly designed for that type of roller, it is also applicable to any roller using the split rolls.

SUMMARY OF THE INVENTION

The problems recounted are accommodated by eliminating the need for any central frame member between the split rolls or the need for any heavy central shaft or other weighty carrying means for the individual roll shells. Instead, the adjacent ends of the roll shells are joined near their outer peripheries by a single, large annular bearing of the well-known "turntable" type so that axial deflection of the two rolls relative to each other is very effectively resisted. At the same time the two races of the bearing overlap in a manner such that, in cooperation with the bearing members between them, axial separation of the two shells is also prevented. Hence, at a single stroke, the two roll shells is are rigidly mounted to each other, yet free to rotate independently, all achieved with an insignificant increase in weight, complexity and cost. Consequently, the eccentric mechanism within the roll, since it is relieved of any load carrying duites and must contend with minimally increased roll weight, can itself be smaller and lighter and yet produce a required amplitude and/or permit higher frequencies without the concomitant difficulties of doing so, as previously set forth, with heavier split rolls. Indeed, both higher frequencies, besides allowing greater travel speed for the roller, and relatively modest amplitudes are usually more desirable than large amplitudes and lower frequencies. In the example to be described, a small, flexibly jointed shaft from a hydraulic motor mounted in the non-vibratory hub of the roll drives a pair of short, relatively light eccentric shafts journaled in the roll shells at their adjacent ends, each of which shafts carries a pair of eccentric weights. Hence, weight, power requirements, bearing sizes, heat dissipation problems, costs and the like are all minimized without impairing the compacting ability of the rolls.

Other and further features and advantages of the present invention will become apparent from the drawing and the more detailed description which follows.

BRIEF DESCRIPTION OF THE DRAWINGS

The single FIGURE is a sectional view taken generally axially through a vibratory split roll according to the invention.

DETAILED DESCRIPTION OF THE PREFERRED EMBODIMENT

The split roll illustrated, which is specifically for an articulated expandable type of roller, is carried between the lower ends of the hat-section legs 10 of a yoke which is swingable about a vertical axis for steering purposes, all as further shown in U.S. Pat. No. 3,868,194 mentioned above. To one leg 10 is bolted the outer end of a hollow hub 11 in which is mounted a hydraulic traction drive motor 12 whose inner end carries a hydraulic brake 13 bolted to a hub inner end plate 14. The latter plate also carries the inner end of the stationary portion 15*a* of a planetary wheel or gearbox 15 having a flange 16 on its rotating portion 15*b* which is bolted to and forms the inner end of a sleeve 17 concentrically enveloping the hub 11. To the outer end of the sleeve 17 is affixed an annular roll shell mounting plate 18. The opposite yoke leg 10 is similarly provided with a hollow hub 20 bolted to it having an inner end wall 21 to which is secured a hydraulic vibrator drive motor 22. An annular mounting flange 23 is welded to the hub 20 intermediate its ends to whose periphery is bolted the inner race of an annular bearing 24, its outer race in turn being bolted to a second annular roll shell mounting plate 25. Spaced about the inner faces of the mounting plates 18 and 25 and bolted to them adjacent their peripheries are the outer ends of a number of elastomeric roll shell mounting cushions 26.

The two halves 30*a* and 30*b* forming the split roll 30 are essentially identical in structure, consisting of co-axial cylindrical roll shells 31*a* and 31*b* whose inner axial ends closely about each other. Adjacent their outer ends the two shells 31*a* and 31*b* are provided with annular mounting plates 32 and 33 to which the inner ends of the cushions 26 are also bolted. The adjacent inner ends of the shells 31*a* and 31*b* are also provided with annular mounting plates 34 and 35 which concentrically surround and carry a pair of hollow cylindrical drums 36 and 37. The latter drums axially mount a pair of axially adjacent short shafts 38 and 39 in bearings 40, the ends of each shaft 38 and 39 exterior of the drums 36 and 37 carrying a pair of eccentric weights 41. The two weights 41 at the adjacent ends of the shafts 38 and 39 are pinned together at 42 so that the shaft 38 can be driven by the shaft 39. The drums 36 and 37, shafts 38 and 39 and the weights 41 thus form a vibratory assembly which is driven from the outer end of the shaft 39 by the motor 22 through a small hollow drive shaft 43 and flexible couplings 44.

Between the drums 36 and 37 and adjacent the inner axial ends of the roll shells 31*a* and 31*b* are welded a pair of opposed annular bearing mounting plates 45 and 46, the plate 46 being radially deeper than the plate 45. Bolted between an annular seat on the opposing face of the plate 46 and that of a smaller annular sandwiching plate 47, closely adjacent the peripheries of the shells 31*a* and 31*b*, is the inner race 51 of a large annular bearing 50 of the turntable type, its outer race 52 in turn being bolted in an annular seat on the opposing face of the plate 45. The joint faces between the races 51 and 52 are parallel to the axis of the roll halves 30*a* and 30*b* and are provided with opposed annular channels carrying ball bearings 53. Finally, the plates 45 and 46 are additionally braced against the plates 34 and 35 by means of web plates 54, and the bearing 50 is lubricated by an exterior fitting 55 and conduit 56 leading into the outer bearing race 52. A spring loaded plunger mechanism 57, shown in its withdrawn position, when released by the exterior handle 58 couples the two roll halves 30*a* and 30*b* together by means of a bolt 59 which engages an aperture (not show) in the plate 47.

Accordingly, the traction motor 12 through the gearbox 15, sleeve 17, plate 18 and cushions 26 normally drives the roll half 30*a* only (for the reasons explained in the foregoing U.S. Pat. No. 3,868,194), the outer end of that roll being in effect supported by the stationary hub 11 to which the motor 12, brake 13, and gearbox portion 15*a* are bolted, while the gearbox portion 15*b*, sleeve 17, plate 18 and cushions 26 rotate with the roll half 30*a*. The outer end of the roll half 30*b*, however, is supported by the bearing 24 so that the plate 25 and cushions 26 rotate with the roll half 30*b* relative to the stationary hub 20 and plate 23. The vibrator motor 22 drives the two eccentric shafts 38 and 39 through their pinned connection 42 and the drive shaft 43 and couplings 44. The force produced by the eccentric weights 41 is thereby transmitted to and through the drums 36 and 37 and plates 34 and 35 directly to each roll shell 31*a* and 31*b*. Owing to the cushions 26 the two roll halves 30*a* and 30*b* thus vibrate as a unit relative to the stationary yoke legs 10, hubs 11 and 20, and the sleeve 17, the flexible couplings 44 absorbing the consequent annular deflections of the vibrator drive shaft 43.

Meanwhile, the adjacent inner ends of the roll halves 30*a* and 30*b* are supported by the turntable bearing 50 for rotation independently of each other. At the same time the bearing 50, as will be observed, also both secures the two roll halves 30*a* and 30*b* against movement in either axial direction as well as against axial deflection relative to each other, all with a minimum of extra weight, complexity and cost. The bearing 50 is basically a standard item but with little or no internal clearance in order to minimize axial deflection of the roll halves 30*a* and 30*b*, the minimal clearance in the bearing 50 being accommodated by careful machining of the annular seats in the mounting plates 45 and 46 for the bearing races 51 and 52. The joint faces between races 51 and 52 of the bearing 50, as will be apparent, could be at an angle rather than parallel to the axis of the roll halves 30*a* and 30*b* and yet secure the latter against axial movement. Indeed, even if those faces were perpendicular to that axis, axial deflection of the roll halves 30*a* and 30*b* would still be precluded, though then some other means would be required to prevent axial separation of the two. Finally, in those instances where extra traction is needed, the plunger mechanism 57 can be released so that the bolt 59 locks the two roll halves 30*a* and 30*b* together, whence the traction motor 12 will thereby drive both as a unitary roll 30.

Though the present invention has been described in terms of a particular embodiment, being the best mode known of carrying out the invention, it is not limited to that embodiment alone. Instead, the following claims are to be read as encompassing all adaptations and modifications of the invention falling within its spirit and scope.

We claim:

1. In a road roller including at least one steerable roll having at least two co-axially adjacent roll shells providing a substantially continuous cylindrical road engaging surface, mounting means for the roll shells permitting vibratory movement thereof relative to remaining portions of the roll, the mounting means further providing for rotation of the roll shells relative to each other, and vibratory means effective upon each roll shell, the improvement wherein the mounting means includes bearing means disposed between the adjacent axial ends of the roll shells effective to permit said rotation thereof relative to each other, the bearing means being further disposed sufficiently adjacent the periphery of the roll shells so that the bearing means by itself is effective to prevent displacement of the roll shells from said co-axial relationship.

2. The machine of claim 1 wherein the bearing means also resist axial displacement of the roll shells away from each other.

3. The machine of claim 2 wherein the bearing means includes spaced bearing blocks secured adjacent the adjacent axial ends of respective ones of the roll shells, the bearing blocks having complementary opposed races therein co-axial with the roll shells, said races overlapping each other in a direction transversely of the radius of the roll shells, and a plurlaity of rotable bearing members disposed in said race effective to provide an interlocking relationship between the bearing blocks to thereby resist said axial and co-axial displacement of the roll shells.

4. The machine of claim 3 wherein the race of each bearing block forms a continuous circular raceway co-axial with the roll shells.

5. The machine of claim 4 wherein the bearing blocks include opposed faces generally parallel to the axis of the roll shells, said raceways being formed in said faces.

6. The machine of claim 5 wherein said raceways are also circular in cross section and the rotable bearing members are spherical in shape.

7. The machine of claim 6 wherein the bearing blocks are generally annular in overall configuration.

8. The machine of claim 1 wherein at least a first one of the roll shells is provided with drive means for propelling the machine along a road.

9. The machine of claim 8 wherein the second one of the roll shells is normally undriven and free to rotate independently of the first roll shell.

10. The machine of claim 9 including means to optionally interconnect the roll shells effective to cause the first roll shell also to drive the second roll shell.

11. The machine of claim 8 wherein the vibratory means include vibration inducing members disposed within and carried by the roll shells, the inducing members being mounted for driven rotation relative to and co-axially with the roll shells.

12. The machine of claim 11 wherein the bearing means includes a pair of spaced bearing members of generally annular configuration, the bearing members being secured adjacent the adjacent axial ends of respective ones of the roll shells, the bearing members having complementary opposed circular raceways therein co-axial with the roll shells, said raceways overlapping each other in a direction transversely of the radius of the roll shells, and a plurality of rotable members disposed in the raceways effective to provide an interlocking relationship between the bearing members to thereby resist axial and co-axial displacement thereof.

13. The machine of claim 12 wherein the raceways are also circular in cross section and the rotable members are spherical in shape.

14. In a steerable roll for a road roller, the roll including a pair of hub assemblies at and supporting the outer axial ends of the roll and a pair of co-axially adjacent roll shells providing a substantially continous cylindrical road engaging surface, the roll shells being mounted for vibratory movement relative to the hub assemblies in directions transversely of the axis of the roll, the two roll shells being capable of rotation relative to each other, and vibratory means disposed within the roll and carried by the roll shells effective to provide said vibratory movement, the improvement comprising: means disposed adjacent the inner axial ends of the roll shells effective to support and maintain said ends in said co-axial relationship and to provide for said rotation of the roll shells relative to each other, said means including an annular bearing assembly co-axial with and carried by the roll shells, the bearing assembly having a sufficiently large diameter to provide substantially all of said effective support and maintenance to the inner axial ends of the roll shells.

15. The roll of claim 14 wherein the vibratory means comprise vibratory members rotable relative to the roll shells and co-axially therewith, and including vibratory drive means for the vibratory members disposed at one of the hub assemblies and an axially flexible drive shaft interconnecting the vibratory members and drive means.

16. The roll of claim 15 wherein the vibratory members include a pair of interconnected vibrator shafts, each shaft being journaled in supporting means extending radially of one of the roll shells and secured thereto adjacent its inner axial end, said drive shaft being connected to one of said vibrator shafts.

17. The roll of claim 15 including roll drive means disposed at the other of the hub assemblies and operative upon at least one of the roll shells for driving rotation thereof about its axis.

18. The roll of claim 17 wherein the other of the roll shells is normally undriven and free to rotate about is axis independently of the driven roll shell.

19. The roll of claim 14 wherein the annular bearing assembly also prevents axial movement of the roll shells away from each other.

20. The roll of claim 19 wherein the annular bearing assembly includes a pair of annular members secured to respective ones of the roll shells, the annular members having complementary opposed circular raceways therein co-axial with the roll shells, and a plurality of rotable members disposed in the raceways, the raceways overlapping each other in a direction transversely of the radius of the roll shells effective to cause the rotable members to provide an interlocking relationship between the annular members and thereby maintain said co-axial relationship of the roll shells and prevent said axial movement thereof.

* * * * *